US012780470B2

(12) United States Patent
Hu et al.

(10) Patent No.: US 12,780,470 B2
(45) Date of Patent: Nov. 3, 2026

(54) DOUBLE-TRACK ROTARY MANIPULATOR CIGARETTE PACK MIXING DEVICE AND A CIGARETTE PACK MIXING METHOD

(71) Applicant: CHINA TOBACCO YUNNAN INDUSTRIAL CO., LTD., Kunming (CL)

(72) Inventors: Yuehang Hu, Kunming (CN); Xi Yang, Kunming (CN); Lun Cai, Kunming (CN); Hongguang Ren, Kunming (CN); Haocheng Cai, Kunming (CN)

(73) Assignee: CHINA TOBACCO YUNNAN INDUSTRIAL CO., LTD., Kunming (CN)

( * ) Notice: Subject to any disclaimer, the term of this patent is extended or adjusted under 35 U.S.C. 154(b) by 0 days.

(21) Appl. No.: 19/439,344

(22) Filed: Jan. 3, 2026

(65) Prior Publication Data

US 2026/0167368 A1 Jun. 18, 2026

Related U.S. Application Data

(63) Continuation of application No. PCT/CN2024/139795, filed on Dec. 17, 2024.

(30) Foreign Application Priority Data

Dec. 16, 2024 (CN) ..... 202411846218.9

(51) Int. Cl.
*B65B 35/56* (2006.01)
*B65B 19/04* (2006.01)
(Continued)

(52) U.S. Cl.
CPC ..... *B65B 35/56* (2013.01); *B65B 19/04* (2013.01); *B65B 19/32* (2013.01); *B65B 35/36* (2013.01); *B65B 57/10* (2013.01)

(58) Field of Classification Search
CPC ..... B65B 35/56; B65B 19/04; B65B 19/32; B65B 35/36; B65B 57/10; B65B 1/24;
(Continued)

(56) References Cited

U.S. PATENT DOCUMENTS 3,951,283 A * 4/1976 Lingl, Jr. ..... B65G 57/22 414/931
4,444,424 A * 4/1984 Lebret ..... B65B 21/20 198/434
(Continued)

FOREIGN PATENT DOCUMENTS

CN 106081189 A 11/2016
CN 110949745 A 4/2020
(Continued)

OTHER PUBLICATIONS

International Search Report, International Appl. No. PCT/CN2024/139795, Aug. 11, 2025, issued by the China National Intellectual Property Administration (ISA/CN), Beijing, China.
(Continued)

*Primary Examiner* — Sameh Tawfik
(74) *Attorney, Agent, or Firm* — Central California IP Group, P.C.; Andrew D. Fortney

(57) ABSTRACT

A double-track rotary manipulator cigarette pack mixing device is disclosed, which includes a cigarette pack conveying module, a rotary transmission module and a pair of manipulator modules, wherein the cigarette pack conveying module includes a first track and a second track arranged vertically in the same horizontal plane, the rotating transmission module is at a perpendicular intersection of the second track and the first track, and the pair of manipulator modules are at ends of the rotating drive module. A method of mixing cigarette packs using the double-track rotating manipulator cigarette pack mixing device is also disclosed.

4 Claims, 2 Drawing Sheets

(51) Int. Cl.
*B65B 19/32* (2006.01)
*B65B 35/36* (2006.01)
*B65B 57/10* (2006.01)

(58) Field of Classification Search
CPC ..... B65B 1/22; B65B 63/028; B65G 47/256; B65G 47/905; B65G 2207/42; B65G 47/901; B65G 2201/0211; B65G 47/907
USPC ..... 53/446
See application file for complete search history.

(56) References Cited

U.S. PATENT DOCUMENTS 5,476,354 A * 12/1995 Crain ..... B65B 69/0033 414/412
6,830,425 B2 * 12/2004 Padovani ..... B65G 57/165 414/788.3
7,234,744 B2 * 6/2007 Osten ..... B25J 15/0616 414/737
8,777,552 B2 * 7/2014 Ward ..... B65G 57/00 414/736
10,954,078 B2 * 3/2021 Crescenzo ..... B65G 47/907
11,267,661 B2 * 3/2022 Boudreau ..... B65B 11/045
11,345,490 B2 * 5/2022 Prakken ..... B65B 63/00
12,172,783 B2 * 12/2024 Draghetti ..... B65B 19/02
2004/0020167 A1 * 2/2004 Bertuzzi ..... B65B 35/46 53/446
2019/0256251 A1 * 8/2019 Parazza ..... B65D 57/005
2020/0207549 A1 * 7/2020 Crescenzo ..... B65G 47/905

FOREIGN PATENT DOCUMENTS

CN 219277934 A 6/2023
CN 117429684 A 1/2024
DE 202024105772 U1 11/2024
EP 1357065 A2 10/2003
EP 3339192 A1 6/2018

OTHER PUBLICATIONS

Written Opinion, International Appl. No. PCT/CN2024/139795, Aug. 11, 2025, issued by the China National Intellectual Property Administration (ISA/CN), Beijing, China.

* cited by examiner

DOUBLE-TRACK ROTARY MANIPULATOR CIGARETTE PACK MIXING DEVICE AND A CIGARETTE PACK MIXING METHOD

TECHNICAL FIELD

The present invention relates to the technical field of tobacco packaging, and specifically relates to a double-track rotating manipulator cigarette pack mixing device and a cigarette pack mixing method.

BACKGROUND

With the rapid development of the tobacco industry, the improvement of the level of tobacco production automation has become an important driving force for the development of the industry. The packaging process of tobacco products is a crucial link in the entire production chain, and its level of automation is directly related to production efficiency, cost control and the stability of product quality. Traditional cigarettes are usually packed in small boxes of the same type for each pack. However, with the diversification of cigarette products, mixed packaging of multiple types of small boxes per package has become an innovation point for cigarette products. In the traditional production process of tobacco packaging, the mixed packaging of various types of small boxes mainly relies on manual sorting and packaging, which is inefficient and prone to errors that not only affects production efficiency, but also increases labor costs. At the same time, the overall quality of cigarette packs may be reduced due to the inefficiency of manual operation.

The present invention is presented for this purpose.

SUMMARY

To solve the technical problems mentioned above, the present invention concerns a double-track rotating manipulator cigarette pack mixing device and a method for mixing cigarette packs into larger cartons. The invention adopts a modular approach, dividing the entire device into several main modules, and through the synergy of these modules, the mixing of different cigarette packs is accomplished.

The technical solution of the present invention is as follows:

A first aspect of the present invention concerns a double-track rotating manipulator cigarette pack mixing device, which comprises: a cigarette pack conveying module, a rotating transmission module and a pair of manipulator modules, wherein the cigarette pack conveying module comprises a first track and a second track arranged perpendicularly in the same horizontal plane, the rotating transmission module is at the perpendicular intersection of the second track and the first track, and the pair of manipulator modules are on opposite sides of the rotating transmission module.

Preferably, the rotating transmission module comprises a cylindrical fixed table, a polyhedral rotating chassis and a cuboid manipulator module frame. The fixed table and the rotating chassis (which may be above the fixed table) are connected by a hydraulic rod. The rotating chassis and the manipulator module frame (which may be above the rotating chassis) are connected to a rotating shaft through a coupling, and the rotating chassis and the manipulator module frame are also symmetrically oriented, with a first link bracket and a second link bracket to fixedly connect opposite ends of the rotating chassis and the manipulator module frame. The fixed table is fixed on a stabilizer, and the stabilizer is fixed on a base. The base is at the vertical intersection of the first track and the second track. The pair of manipulator modules may be at the lower ends of the manipulator module frame. A motor is fixed in the middle of an upper surface of the manipulator module frame, and the rotating shaft is connected to the motor through the manipulator module frame.

Preferably, the manipulator module frame has rectangular manipulator moving slots are at respective lower ends of the manipulator module frame, and the pair of manipulator modules are in respective ones of the manipulator moving slots, and can move laterally in their respective manipulator moving slot.

Preferably, each manipulator module comprises a first clamping plate, a second clamping plate, a clamping plate crossbeam, a first column, a second column, and a fixed crossbeam. The first clamping plate and the second clamping plate are at lower ends of the clamping plate crossbeam. The clamping plate crossbeam is fixedly connected to the fixed crossbeam (which may be above the clamping plate crossbeam) by the first column and the second column. A connecting shaft is in the middle of an upper surface of the fixed crossbeam. The connecting shafts are at opposite ends of the rotating transmission module.

Preferably, the clamping plate crossbeam has a lower end that includes a rectangular clamping plate slot, and the first clamping plate and the second clamping plate are linked in the clamping plate slot by mechanical components. The first clamping plate and the second clamping plate have the same size and shape, and include opposed surfaces with cushioning material thereon.

Preferably, the cigarette pack mixing device further comprises a camera and a sensor between the first clamping plate and the second clamping plate in the clamping plate slot.

Preferably, the cigarette pack mixing device further comprises a detection device downstream of the first track.

Preferably, the cigarette pack mixing device further comprises a sealing ring on the outside of the rotating shaft on an upper surface of the rotating chassis.

A second aspect of the present invention concerns a method of mixing cigarette packs using the double-track rotating manipulator cigarette pack mixing device, including the following steps:

(i) Starting the motor, starting and initializing the rotating transmission module and the manipulator modules, and positioning the pair of manipulator modules above the first track and the second track, respectively;

(ii) Starting the cigarette pack conveying module so that a first type of cigarette pack and a second type of cigarette pack are delivered to set positions on the second track in a set sequence and quantity;

(iii) Positioning at least one of the manipulator modules by sliding within the corresponding clamping plate slot based on the camera and sensor in the corresponding clamping plate slot, then lowering the rotating transmission module and the at least one manipulator module using the hydraulic rod to grasp the first type cigarette pack or the second type cigarette pack (e.g., on the second track);

(iv) Raising the hydraulic rod to a certain height, rotating the rotating transmission module 180°, lowering the hydraulic rod again, lowering the at least one manipulator module grasping the first type of cigarette pack or the second type of cigarette pack, and placing the grasped first type of cigarette pack or the grasped second type of cigarette pack at a set position on the first track;

(v) Repeating steps (iii) and (iv), depending on the quantity of the first and second types of cigarette packs;

(vi) After the quantity of the first and second types of cigarette packs are on the first track, moving the first track, and inspecting the types and quantity of the cigarette packs on the first track using the detection device.

Preferably, each step in the above method is controlled and operated by an automatic control system.

The beneficial effects of the present invention include:

1. The double-track rotary manipulator cigarette pack mixing equipment of the present invention includes a cigarette pack conveying module, a rotary transmission module and a manipulator module. The core lies in the unique vertical double-track design of the cigarette pack conveying module. During the operation of the equipment, multiple different types of cigarette packs can be processed simultaneously. This design significantly enhances the operating speed and production capacity of the production line. At the same time, by using high-precision camera sensors and control systems, the present device can achieve precise control of the position of the cigarette packs, ensuring the accuracy of the cigarette pack placement during rotation and flipping, thereby ensuring the quality of the final product.
2. The double-track rotary manipulator cigarette pack mixing equipment of the present invention introduces the arrangement and packaging of two types of cigarette packs that can be conveyed through two tracks, achieving the mixing of various types of cigarette packs and automatically completing the arrangement and packaging of different types of cigarette packs by the control of an automated system. It enhances the flexibility and efficiency of the production line and reduces labor costs.
3. The present equipment is characterized by intelligence, automation, efficiency and precision. The cost of equipment transformation is low, and a large amount of labor cost can be saved at the same time. The cigarette products produced in mixed packs can be adjusted in a timely manner according to market demand and have strong adaptability.

Figure 1:
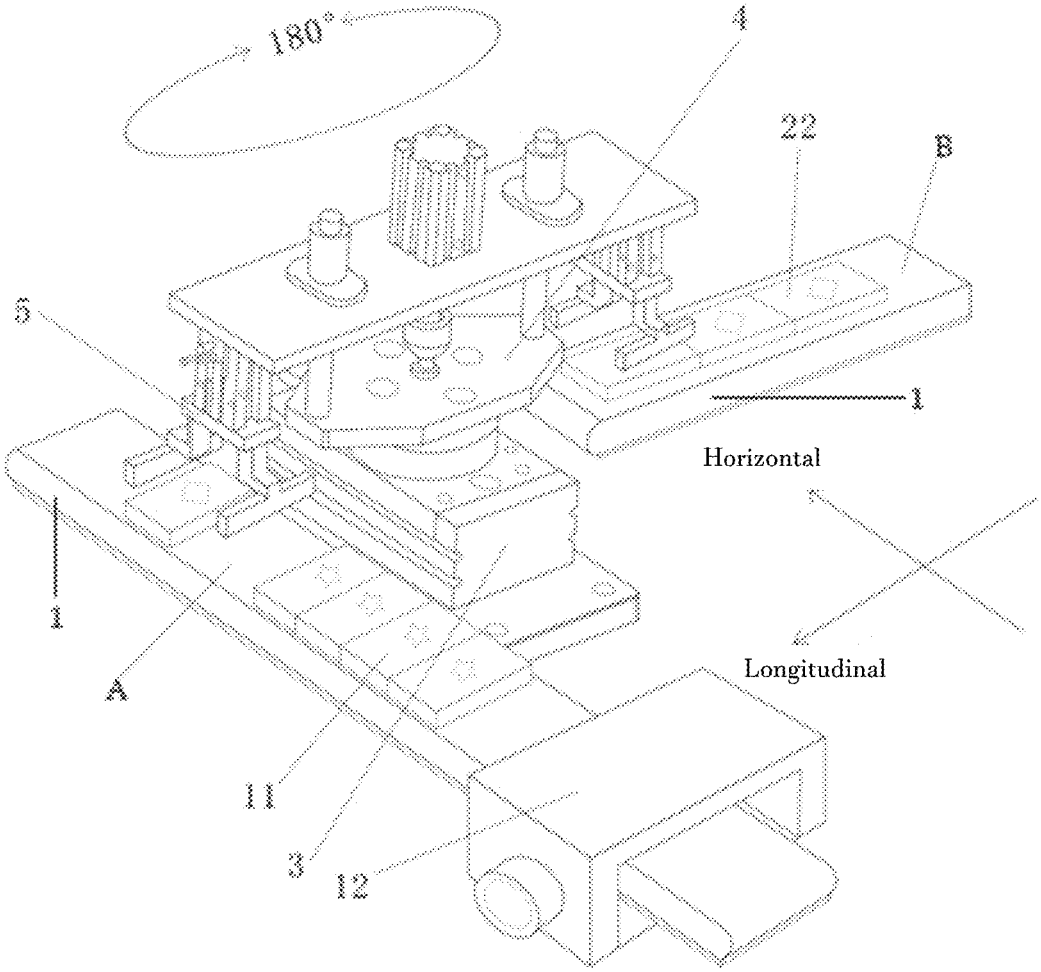
FIG. 1 is a schematic diagram of the structure of the double-track rotating manipulator cigarette pack mixing equipment of the present invention.

In the attached drawings, the identified structures are: 1. Cigarette pack delivery module; A. First track; B. Second track; 11. First type cigarette pack; 22. Second type of cigarette pack; 12. Positioning detection device; 3. Stabilizer; 31. Base; 4. Rotating transmission module; 41. Fixed table; 42. Hydraulic rods; 43. Rotating chassis; 44. Manipulator module frame; 441. Manipulator movable slot; 45. First link bracket; 46. Second link bracket; 47. Coupling; 48. Rotating shaft; 49. Seal; 50. Motor; 5. Manipulator module; 51. First clamping plate; 52. Second clamping plate; 53. Cushioning material; 54. Clamping plate crossbeam; 541. Clamping plate slot; 55. First column; 56. Second column; 57. Fixed crossbeam; 58. Connecting shaft.

DETAILED DESCRIPTION

In order to make the objectives, technical solutions, and advantages of the present invention clearer, the invention is further described in detail below in conjunction with the accompanying drawings and embodiments. Those skilled in the art will understand that the following embodiments are used only to illustrate the invention and should not be regarded as limiting the scope of the invention. For embodiments where specific techniques or conditions are not specified, conventional techniques or conditions described in the relevant literature or product manuals can be followed. Materials or equipment for which the manufacturer is not specified are conventional and commercially available.

Those skilled in the art may understand that, unless otherwise stated, the singular forms "one," "said" and "should" used here may also include the plural form. It should be further understood that the term "including" and "comprising" used in the specification of the present invention means the existence of the features, integers, steps, operations, elements and/or components, but does not exclude the existence or addition of one or more other features, integers, steps, operations, elements, components and/or groups thereof. It should be understood that when we say an element is "linked" to another element, it may be directly linked to other elements, or there may also be intermediate elements. Also, the "link" used here can include wireless links.

In the description of the present invention, it should be understood that the terms "center," "vertical," "horizontal," "length," "width," "thickness" and "up," "down," "before" and "after," "left," "right," "vertical," "level," "top," "bottom," "inside" and "outside" and the like indicate orientation or positional relationships, based on the orientation or positional relationships shown in the drawings. Such terms are used solely for the purpose of facilitating the description of the invention and simplifying the description, and do not indicate or imply that the device referred to must have a particular orientation, or be constructed and operated in a particular orientation. Therefore, they should not be construed as limiting the invention.

Furthermore, the terms "first," "second," "third," etc., are used for descriptive purposes only and should not be construed as indicating or suggesting relative importance or implicitly indicating the number of technical features indicated.

In the present invention, unless otherwise expressly specified and limited, terms such as "installed," "connected," "linked," "fixed," "bonded," etc., should be understood in a broad sense, for example, they can be integrated, permanently connected, or detachably connected. For those skilled in the art, the specific meanings of the above terms in the present disclosure can be understood according to the context of their use.

It can be understood by those skilled in the art that, unless otherwise defined, all terms used here, including technical and scientific terms, have the same meaning as is generally understood by those skilled in the art to which the invention belongs. It should also be understood that terms such as those defined in a general dictionary should be construed as having meanings consistent with those in the context of the prior art and should not be interpreted in idealized or overly formal terms unless defined otherwise herein.

As shown in FIG. 1, a double-track rotating manipulator cigarette pack mixing device of the present invention comprises a cigarette pack conveying module 1, a rotating transmission module 4 and a pair of manipulator modules 5, wherein the cigarette pack conveying module 1 comprises a first track A and a second track B arranged perpendicularly in the same horizontal plane, the rotating transmission module 4 is at the perpendicular intersection of the second track B and the first track A, and the pair of manipulator modules 5 are respectively at opposite ends of the rotating transmission module 4. The speeds of the first track A and the second track B are respectively controlled by two sets of control systems. The design of the tracks must not only have a certain width to accommodate the size of the cigarette pack, but also have sufficient length to ensure smooth delivery and intermittent pauses, allowing the cigarette packs to move steadily under the action of the manipulator modules and achieve accurate arrangement. The main structure of the device of the present invention also includes a positioning detection device 12 to ensure the correctness of the types, quantities and positions of the mixed cigarette packs. The design of the main structure of the device of the present invention is key to ensuring that the mechanical manipulator modules 5 can perform the tasks of rotating and mixing the cigarette packs precisely and efficiently. The main structure of the device of the present invention can not only accommodate the automatic conveying, rotation and arrangement of various types of cigarette packs, but also ensure work efficiency and accuracy, thereby preventing the incorrect placement or omission of the cigarette packs.

Figure 3:
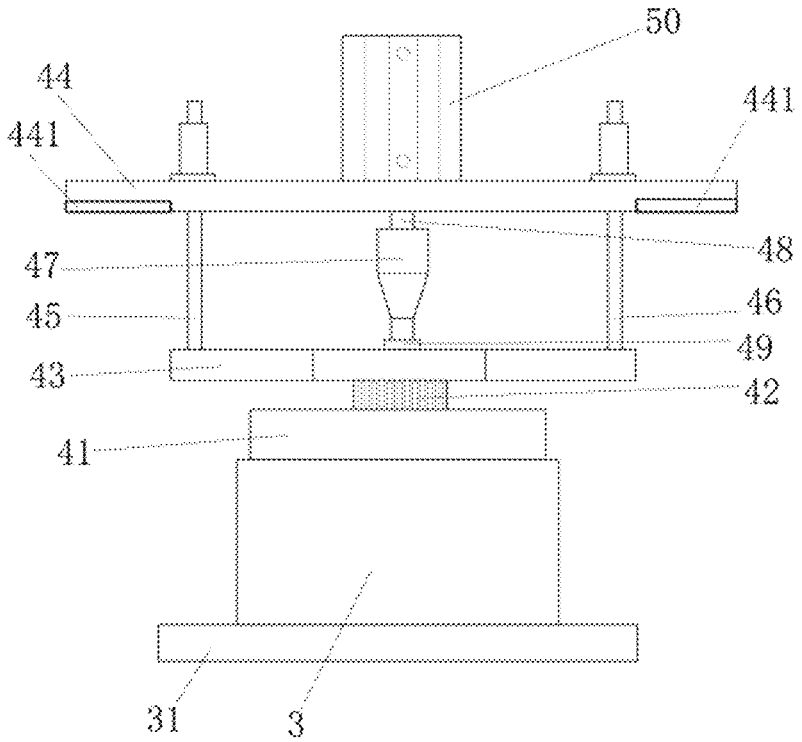
FIG. 3 is a schematic diagram of the structure of the rotating transmission module of the present invention.

The rotating transmission module 4, as shown in FIG. 3, comprises a cylindrical fixed table 41, a polyhedral rotating chassis 43 and a rectangular manipulator module frame 44. The fixed table 41 and the rotating chassis 43 above it are connected by a hydraulic rod 42. The fixed table 41 includes a gearbox. The rotating chassis 43 and the manipulator module frame 44 above it are connected to the rotating shaft 48 by a coupling 47, and the rotating chassis 43 and the manipulator module frame 44 also include symmetrically arranged first link bracket 45 and second link bracket 46 that fixedly connect opposite ends of the rotating chassis 43 and the manipulator module frame 44. The rotating chassis 43 and the manipulator module frame 44 are parallel and are fixed and linked by the first link bracket 45 and the second link bracket 46, which are perpendicular to the rotating chassis 43 and the manipulator module frame 44. The mounting table 41 is fixed on a stabilizer 3, which is fixed on a base 31. The base 31 is at the vertical intersection of the first track A and the second track B. The stabilizer 3 is on the base 31 to provide sufficient strength and stability to support the weight of the two manipulator modules 5 and to ensure smooth, stable high-speed rotation of the two manipulator modules 5. The base 31 is located at the vertical intersection of Track A and Track B. Two manipulator modules 5 respectively extend from the lower surface of the manipulator module frame 44, at opposed ends of the manipulator module frame 44. A motor 50 is fixed in the middle of the manipulator module frame 44, on the upper surface of the manipulator module frame 44, and the rotating shaft 48 is connected to the motor 50 through the manipulator module frame 44. The lower surface of the manipulator module frame 44 at the opposed ends respectively includes rectangular manipulator moving slots 441. The two manipulator modules 5 are in the manipulator moving slots 441, and can move laterally in their respective manipulator moving slot 441. The coupling 47 connects the motor 50 and the rotating shaft 48 to transmit torque and to drive the entire lower rotating chassis 43 and the 180° rotation of the manipulator module frame 44. The motor 50 can be selected according to the desired or required torque and speed, and the control circuit is designed to achieve precise 180° rotation control.

Figure 4:
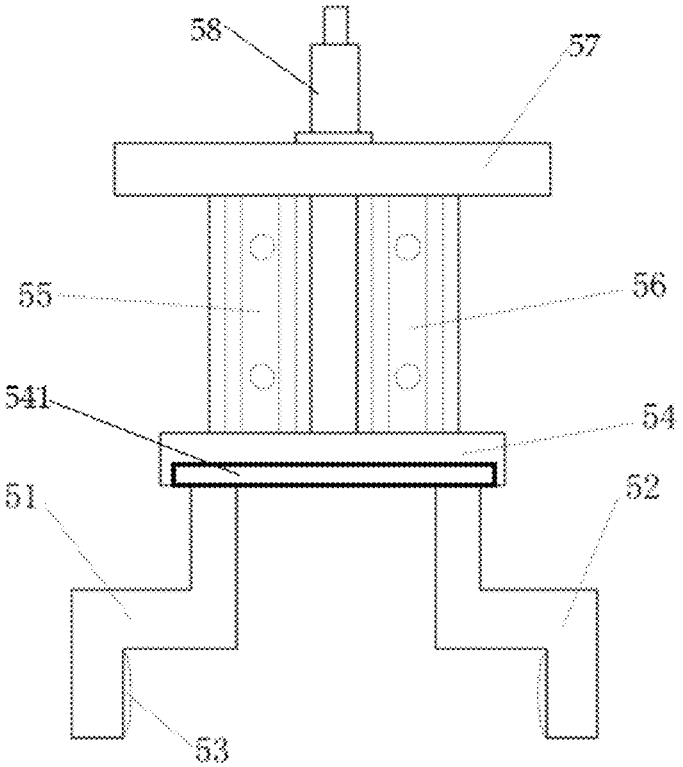
FIG. 4 is a schematic diagram of the mechanical manipulator module of the present invention.

Each manipulator module 5, as shown in FIG. 4, includes a first clamping plate 51, a second clamping plate 52, a clamping plate crossbeam 54, a first column 55, a second column 56, and a fixed crossbeam 57. The first clamping plate 51 and the second clamping plate 52 face each other at opposite sides of the lower part of the clamping plate crossbeam 54. The clamping plate crossbeam 54 is fixedly connected to the fixed crossbeam 57 above it by the first column 55 and the second column 56. A connecting shaft 58 is above the fixed beam 57, fixed in the middle of the fixed beam 57. The connecting shafts 58 are at opposite ends of the rotating transmission module 4. The lower end of the clamping plate crossbeam 54 includes a rectangular clamping plate slot 541, and the first clamping plate 51 and the second clamping plate 52 are linked in the clamping plate slot 541 by mechanical components. The first clamping plate 51 and the second clamping plate 52 have the same size and shape, and a cushioning material 53 is on each of their facing surfaces. The manipulator module 5 grasps the cigarette pack by clamping the first and second clamping plates 51 and 52 together, through horizontal movement of the first and second clamping plates 51 and 52 opening and closing the space between the first and second clamping plates 51 and 52. For the design of the first clamping plate 51 and the second clamping plate 52, cushioning material 53 is on each of their facing surfaces, which should have a certain strength and softness to achieve precise clamping force, suitable for the shape and size of the cigarette pack. The clamping plate crossbeam 54 is a fixed horizontal device with a rectangular clamping plate slot 541 in its lower surface, which is mechanically linked to the first clamping plate 51 and the second clamping plate 52, supporting the gripper to move horizontally according to preset widths and parameters (e.g., matching or corresponding to those of the cigarette pack[s]). The fixed crossbeam 57 is also a fixed horizontal device, fixedly connected to the clamping plate crossbeam 54 by the first column 55 and the second column 56, with the first column 55 and the second column 56 located on either side of the fixed crossbeam 57 and the clamping plate crossbeam 54, placed at a vertical angle at the bottom of the manipulator module frame 44. Its positioning ensures that, during the periodic reciprocating rotation of the entire rotating module over a 180° angle, it can correspond to the positions of cigarette packs on the first track A and the second track B, allowing the gripper to accurately perform the grasping action. The first column 55 and the second column 56 are equipped with drive conduction devices controlled by the automatic control system, which is also connected to the motor 50 to control the corresponding actions of the rotating transmission module 4 and the mechanical manipulator module 5.

A camera and a sensor (not shown in the figures) are installed between the first plate 51 and the second plate 52 in the plate slot 541.

A detection device 12 is set downstream along the first track A, as shown in FIG. 1.

A sealing ring 49 is on the outside of the rotating shaft 48, on the upper surface of the rotating chassis 43. The sealing ring 49 is outside the rotating shaft 48 and is on (e.g., fixed to) the upper surface of the lower rotating chassis 43 to prevent dust and tobacco from entering (e.g., the hydraulic rod 42).

The control technology of the manipulator modules 5 is a complex system that integrates multiple control strategies, requiring high-precision position control and smooth speed control, as well as the integration of intelligent technology to enhance adaptability and intelligence. The control technology of the manipulator modules 5 mainly includes position control, speed control, and force control.

Position control: The present invention uses a closed-loop control system to obtain the position information of the first and second clamping plates 51 and 52 of the manipulator modules 5 in real time using sensors such as encoders or laser rangefinders, and adjusts the movement trajectory of the manipulator using position control algorithms to ensure that it can precisely deliver the cigarette packs to the next station.

Speed control: The speed control of the present invention ensures the smoothness and repeatability of the manipulator modules 5 during movement. By combining position control and speed control, various operations such as smooth starts, runs, and stops are achieved to ensure the smooth operation of the manipulator modules 5.

Force control: By installing tactile sensors, the control system can accurately monitor and adjust the contact force between the first and second clamping plates 51 and 52 of the manipulator modules 5 and the cigarette pack, and precisely adjust the grip force to fit the physical properties of the cigarette pack and avoid excessive compression or rupture.

The manipulator modules 5 are core components of the double-track rotary manipulator cigarette pack mixing device of the present invention, whose main function is to achieve automatic grasping, rotation and placement of cigarette packs. When grasping and placing cigarette packs, it is necessary to ensure that the movement trajectories of the first clamping plate 51 and the second clamping plate 52 match the position of the target cigarette pack. This requires precise positioning of the manipulator modules 5 to ensure the accuracy of the grasp. Positioning techniques mainly include visual positioning, sensor positioning and machine vision positioning, etc.

Visual positioning involves capturing images using a camera and then determining the position of the manipulator using image processing technology. The advantage of this method is its high precision, but it is greatly affected by factors such as ambient light and shadow. High-performance image processing algorithms can eliminate various interfering factors.

Sensor-based positioning involves using sensors installed at key parts of the manipulator to monitor its position and posture in real time. The advantage of this method is its fast response and good real-time performance, but precise calibration and maintenance of the sensors is beneficial for optimum performance.

Machine vision positioning combines the advantages of visual positioning and sensor-based positioning, achieving precise control of the position and posture of the manipulator using advanced image processing algorithms and sensor data. The advantages of this method are that it is highly accurate, it provides good real-time performance, and it is not affected by environmental factors. In the present invention, a camera and a sensor (not shown in the drawings) are installed between the first clamping plate 51 and the second clamping plate 52 in the clamping plate slot 541. The invention employs machine vision positioning technology. The image of the cigarette pack is first captured by a high-definition camera, then the position information of the cigarette pack is extracted by an image processing algorithm, combined with data from the sensor in the slot 541 of the clamping plate crossbeam 54 to calculate the motion trajectory of the corresponding manipulator module 5, and finally the motion trajectory of the manipulator module 5 is adjusted by the control system to achieve precise positioning. Deep learning algorithms can be used in various implementations to optimize the image processing algorithm and improve the positioning accuracy. At the same time, an optimized control algorithm can be used to increase the movement speed and accuracy of the manipulator modules 5.

Using the double-track rotating manipulator cigarette pack mixing equipment of the present invention for the cigarette pack mixing method may comprise the following steps.

(i) Start the motor 50, start and initialize the rotating transmission module 4 and the manipulator modules 5, and position the two manipulator modules 5 above the first track A and the second track B, respectively. Initialization is the process of starting up and initializing the rotary transmission module 4 and the manipulator modules 5, which includes but is not limited to the startup of the equipment and the establishment of a communication connection with the central control system. After the communication connection is established, an important step is to send instructions to the manipulator modules 5 to return to their origin positions. This ensures that the mechanical structures and moving parts of the manipulator modules 5 are in the correct position and in a ready state before commencing work.

(ii) Activate the cigarette pack delivery module so that the first type of cigarette pack 11 and the second type of cigarette pack 22 are delivered in a set sequence and quantity to set positions on the second track B. At this stage, the two types of cigarette packs are respectively conveyed to the designated positions by the second track B, which may be controlled by a separate control system, and the running speed and pause periods of the first and second tracks A and B differ to comply with the motion cycle of the rotating drive module 4, as well as the mixing ratio and quantity of the mixed cigarette packs.

(iii) Based on the camera and sensor in the clamping plate slot 541, position the clamping plates 51 and 52 in at least one of the manipulator modules 5 by sliding the plates 51 and 52 in the clamping plate slot 541. After the positioning is completed, lower the rotating transmission module 4 and the manipulator module(s) 5 using the hydraulic rod 42 to grasp the first type cigarette pack 11 or the second type cigarette pack 22, whichever is in the set position on the second track B. This process requires precise data exchange between the positioning system of the manipulator modules 5 and the control system, and relies on the precise control of the control system to complete the grasping action of the first type of cigarette pack 11 or the second type of cigarette pack 22.

(iv) Raise the hydraulic rod 42 to a certain height, rotate the rotating transmission module 4 180°, lower the hydraulic rod 42 again, and lower the manipulator module 5 grasping the first type of cigarette pack 11 or the second type of cigarette pack 22, and place the grasped first type of cigarette pack 11 or the grasped second type of cigarette pack 22 in the set position on the first track A.

(v) Repeat steps (iii) and (iv), depending on the quantity of the first and second types of cigarette packs (e.g., on the second track B).

Figure 2:
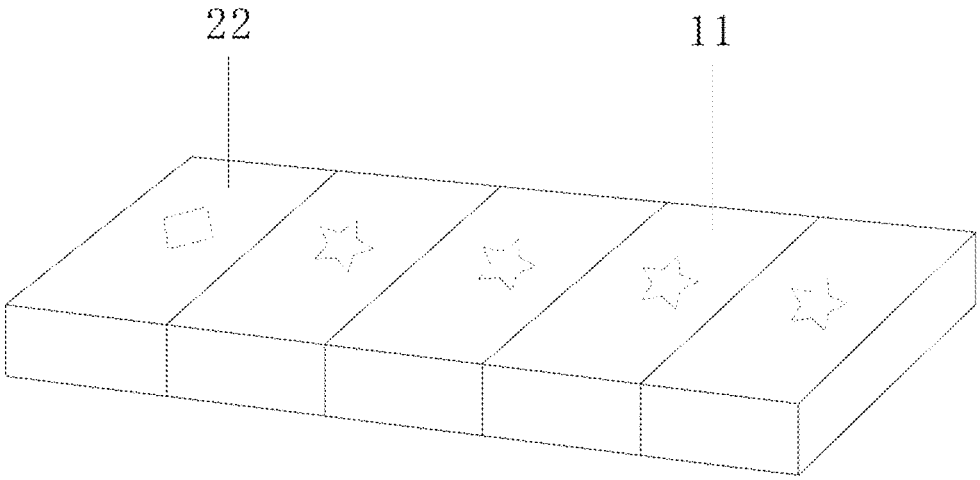
FIG. 2 is a schematic diagram of the packaging form of mixed cigarette packs mixed by the present invention.

(vi) After the quantities of the first and second types of cigarette packs mixed by the present method are on the first track A (as shown in FIG. 2), move the first track A, and inspect the types and quantities of the cigarette packs using the detection device 12. Thereafter, ten different types of small box strip packaging (strip packaging is not within the protection scope of the present invention) may be carried out to complete one operation cycle of cigarette pack mixing.

The above steps may be controlled by an automatic control system.

The above embodiments show and describe the basic principles, main features and advantages of the present invention. It should be known to those skilled in the art that the invention is not limited to the above embodiments, which only illustrate the principles of the invention and, without departing from the spirit and scope of the invention, there can be various changes and improvements to the invention, all of which fall within the scope of the invention for which protection is claimed. The scope of protection of the invention is defined by the appended claims and their equivalents.

What is claimed is:

1. A double-track rotary manipulator cigarette pack mixing device, comprising:

a cigarette pack conveying module, a rotating transmission module, a pair of manipulator modules, a fixed table, a stabilizer, a motor and a base, wherein:

the cigarette pack conveying module comprises a first track and a second track arranged perpendicularly in a same horizontal plane, the rotating transmission module is at a perpendicular intersection of the second track and the first track, and comprises a cylindrical fixed table, a polyhedral rotating chassis and a rectangular manipulator module frame, the fixed table and the rotating chassis are connected by a hydraulic rod;

the rotating chassis and the manipulator module frame are connected by a coupling and a rotating shaft, the rotating chassis and the manipulator module frame are symmetrically oriented, with a first link bracket and a second link bracket to fixedly connect opposite ends of the rotating chassis and the manipulator module frame;

the fixed table is fixed on the stabilizer, and the stabilizer is fixed on the base;

the base is in the same horizontal plane as the first track and the second track;

the motor is fixed in a middle of an upper surface of the manipulator module frame, the rotating shaft is connected to the motor through the manipulator module frame, and the pair of manipulator modules are on opposite sides of the rotating transmission module.

2. The double-track rotating manipulator cigarette pack mixing device as claimed in claim 1, wherein the manipulator module frame has rectangular manipulator moving slots at respective lower ends of the manipulator module frame, and the pair of manipulator modules are in respective ones of the manipulator moving slots, and can move laterally therein.

3. The double-track rotary manipulator cigarette pack mixing device as claimed in claim 2, further comprising a sealing ring outside the rotating shaft, on an upper surface of the rotating chassis.

4. The double-track rotary manipulator cigarette pack mixing device as claimed in claim 1, further comprising a detection device downstream of the first track.

* * * * *